US007568433B1

(12) United States Patent
Farina et al.

(10) Patent No.: US 7,568,433 B1
(45) Date of Patent: Aug. 4, 2009

(54) AERODYNAMICALLY STABLE FINLESS PROJECTILE

(75) Inventors: Anthony P. Farina, Hackettstown, NJ (US); Brian C. Wong, Hamburg, NJ (US); Stewart L. Gilman, Budd Lake, NJ (US); Donald Chin, Parsippany, NJ (US); Joseph D. Wu, Wharton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 11/535,107

(22) Filed: Sep. 26, 2006

Related U.S. Application Data

(60) Provisional application No. 60/766,957, filed on Feb. 22, 2006.

(51) Int. Cl.
*F42B 10/00* (2006.01)
*F42B 5/24* (2006.01)
*F42B 8/00* (2006.01)

(52) U.S. Cl. ..... 102/439; 102/501; 102/517; 102/529; 244/3.24

(58) Field of Classification Search ..... 102/439, 102/517, 501, 529; 244/3.24
See application file for complete search history.

(56) References Cited

U.S. PATENT DOCUMENTS 463,922 A * 11/1891 Russell ..... 244/3.23
3,437,289 A * 4/1969 Biehl et al. ..... 244/3.23
3,724,376 A * 4/1973 Kordas et al. ..... 102/432
3,741,122 A * 6/1973 Kordas, Jr. ..... 102/432
3,951,038 A * 4/1976 Van Langenhoven ..... 89/7
4,241,660 A * 12/1980 Donovan ..... 102/473
5,086,703 A * 2/1992 Klein ..... 102/439
5,092,246 A * 3/1992 Huerta ..... 102/439
5,164,538 A * 11/1992 McClain, III ..... 102/517
5,328,130 A * 7/1994 Gilman et al. ..... 244/3.23
5,498,160 A * 3/1996 Farina et al. ..... 434/12
5,725,179 A * 3/1998 Gilman et al. ..... 244/3.24
5,796,031 A * 8/1998 Sigler ..... 102/520
6,067,909 A * 5/2000 Knoster, Jr. ..... 102/517
6,123,289 A * 9/2000 Manole et al. ..... 244/3.24
6,752,084 B1 * 6/2004 Husseini et al. ..... 102/466
6,782,828 B2 * 8/2004 Widener ..... 102/502
6,782,830 B1 * 8/2004 Candland et al. ..... 102/526
6,832,557 B2 * 12/2004 Torsten ..... 102/439
6,889,612 B1 * 5/2005 Liaw et al. ..... 102/477
6,964,232 B2 * 11/2005 Eberhart et al. ..... 102/439
7,150,234 B2 * 12/2006 Gilman et al. ..... 102/517
2003/0136293 A1 * 7/2003 Torsten ..... 102/439
2003/0136294 A1 * 7/2003 Guse ..... 102/444
2003/0140813 A1 * 7/2003 Rosenkranz et al. ..... 102/473
2006/0278114 A1 * 12/2006 Millard ..... 102/439
2007/0151474 A1 * 7/2007 Widener ..... 102/501

* cited by examiner

*Primary Examiner*—Bret Hayes
*Assistant Examiner*—Michael D David
(74) *Attorney, Agent, or Firm*—Michael C. Sachs

(57) ABSTRACT

A finless projectile provides improved ease of use, aerodynamics, muzzle velocity, drag, target, and excursion accuracy, structural integrity, terminal effectiveness and safety, at lower cost. The finless projectile includes a slug, a forward projectile body, an aft projectile body, an obturator, and a pad. The finless projectile is a full bore projectile that defines a hollow core, but does not include a sabot nor does it carry explosives. The finless projectile functions by kinetic energy transfer from the projectile to the target by deforming the target. The center of gravity of the finless projectile is forward of the center of pressure to provide static stability to the finless projectile.

10 Claims, 6 Drawing Sheets

AERODYNAMICALLY STABLE FINLESS PROJECTILE

US GOVERNMENTAL INTEREST

The inventions described herein may be manufactured, used and licensed by or for the U.S. Government for U.S. Government purposes.

FIELD OF THE INVENTION

The present invention generally relates to the field of munitions. More specifically, the present invention pertains to a non-explosive and aerodynamically stable finless projectile that is launched for explosive ordnance disposal.

BACKGROUND OF THE INVENTION

Terminal effectiveness is a primary criterion for projectiles. Depending on the function of the projectile, the impact velocity at the target primarily generally determines the terminal effectiveness of the projectiles, such as fin stabilized, sub-caliber armor piercing projectiles. The aerodynamic drag and related velocity decay during flight affect the impact velocity. In a conventional fin stabilized projectile, a shortening is made of the length of the acceleration transfer interface between sub-caliber projectile and discarding sabot. In this particular disclosure, the sabot is provided with multiple annular or helical grooves that match those on the sub-caliber projectile. Typically, the multiple annular rings or helical grooves occupy a substantial portion on the length of the projectile.

The reduction in length of the acceleration transmitting interface permits its location to a position aft of the point of boundary layer transition from laminar to turbulent flow, leading to low frictional coefficient of the laminar boundary layer over a large portion of the sub-caliber projectile. The resulting reduction in aerodynamic drag is particularly effective for mid caliber projectiles that improve impact velocity. Reference is made, for example, to U.S. Pat. No. 5,413,049.

Generally, conventional projectiles that are provided with sabots, create high velocity fragments after launch as the sabots shatter into pieces and the projectile transitions from aft incident to front incident air stream at high velocity. The shattered pieces from the sabot correspond to the original pieces that made up the sabot assembly. In the specific case of a multi-piece finned projectile that is fired from a 40 mm De-Armer rifle, the sabot assembly has 9 pieces. The sabot shatters apart after muzzle launch into 9 or more pieces at high velocity, posing a hazard to personnel close to the weapon and potentially increasing collateral damage. The shattering of the sabot after launch also creates an airflow disturbance that degrades the aiming accuracy of the projectile and degrades the muzzle velocity and ultimately the impact velocity.

Moreover, the complex assembly of a projectile with a sabot is relatively more costly to fabricate and manufacture. Each component needs to be precisely made since it needs to be assembled with numerous other components, in order to minimize asymmetry and distortion, for achieve structural integrity.

Thus, it is apparent that there exists a need for an improved projectile that presents greater safety than conventional projectiles, and that does not cause fragments to be dispersed at high velocity, during launch from a weapon. The projectile design should maximize impact velocity, terminal effectiveness, and range and aiming accuracy, and it should further be amenable to low cost mass production. The need for such a projectile has heretofore remained unsatisfied.

SUMMARY OF THE INVENTION

The present invention satisfies the foregoing need. While the present invention will be described in relation to a 40 mm De-Armer rifle, the present projectile can be designed for use in other weapons.

It is a goal of the present invention to provide a non-explosive, low cost finless projectile that prevents high velocity fragments from being dispersed in the vicinity of the launch weapon.

It is another goal of the present invention to provide an aerodynamically stable projectile with high impact velocity and terminal effectiveness.

It is still another goal of the present invention to provide a versatile non-explosive projectile for explosive ordnance disposal.

The foregoing objects and features of the present invention are achieved by a projectile that generally includes a slug, a forward projectile body, an obturator, an aft projectile body, and a pad. The slug and both the forward and aft projectile bodies accommodate a hollow core. These components are integrally assembled to form a non-explosive and aerodynamically stable finless projectile that is launched, for example, for explosive ordnance disposal or for breaking open a lock in tactical operations.

The slug of the present system forms part of a finless projectile that has a non-homogenous weight distribution, with most of the weight of the slug disposed toward the front, followed by a hollow core enclosed by the forward and aft projectile bodies and a closed end. Consequently the center of gravity (C.G.) is frontal to the center of pressure (C.P.) of the finless projectile. In addition, the front portion of the slug includes a bullet shaped tip, such that upon impact with a target, most of the kinetic energy in the projectile is transferred to the target to accomplish a specific function. In other words, little kinetic energy of the projectile is consumed in the deformation of the slug and the projectile upon target impact.

The finless projectile of the present invention differs from a conventional sub-caliber projectile in many respects. As an example, in contrast to a conventional sub-caliber projectile with a sabot, the present finless projectile is full bore such that the projectile's cross-section approaches that of the launching bore, and provides a larger diameter than the conventional sub-caliber projectile for the slug at the front. As a result, the present slug assumes a substantially bullet shape that minimizes the energy converted from the projectile's kinetic energy to deformation energy on the slug and projectile upon target impact. In other terms, more kinetic energy is transmitted to the target with the present finless projectile than with comparable conventional projectiles. Still in other terms, the present finless projectile improves terminal effectiveness.

An additional feature of the present finless projectile is the hollow core. The forward and aft projectile bodies that accommodate the hollow core provide for the projectile wall and minimize drag of the projectile while minimizing the weight of the projectile. Consequently most of the weight of the projectile is contributed by the slug at the front portion, minimizing the energy converted from the projectile's kinetic energy to deformation energy upon target impact. In other terms, more kinetic energy is transmitted from the present finless projectile to the impacted target than with other comparable conventional projectiles.

The slug in the front part of the finless projectile is integrally assembled with the forward projectile body and creates a circumferential shoulder at the junction. This circumferential shoulder provides aerodynamic balance to the projectile in its trajectory after muzzle launch.

The aft projectile body is provided with an obturator that has the largest cross-sectional outer diameter of the components of the projectile. When the finless projectile is launched in the barrel, the obturator seals the propellant gases in the weapon and prevents them from leaking out of the barrel, past the projectile during muzzle launch. The obturator replaces the function of the sabot in the conventional sub-caliber projectile.

The aft projectile body of the finless projectile is also provided with a plurality of grooves to induce spin to the projectile once after muzzle launch. The spin enhances the aerodynamic stability of the projectile without the use of fins.

BRIEF DESCRIPTION OF THE DRAWINGS

The various features of the present invention and the manner of attaining them will be described in greater detail with reference to the following description, claims, and drawings, wherein reference numerals are reused, where appropriate, to indicate a correspondence between the referenced items, and wherein:

DETAILED DESCRIPTION OF PREFERRED EMBODIMENTS

Figure 1:
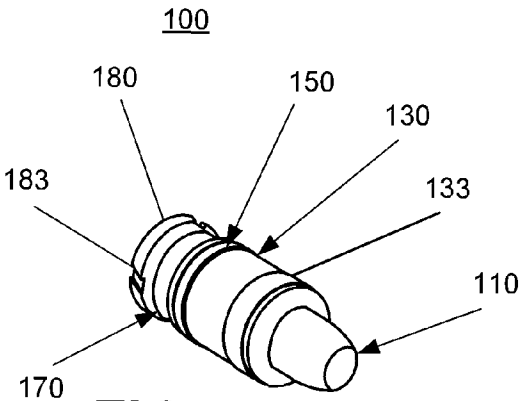
FIG. 1 is an isometric view of an exemplary finless projectile of the present invention without a sabot, and provided with angled grooves to induce a spin during flight, and further showing the center of gravity (C.G.) as being frontal to the center of pressure (C.P.) of the projectile.
Figure 2:
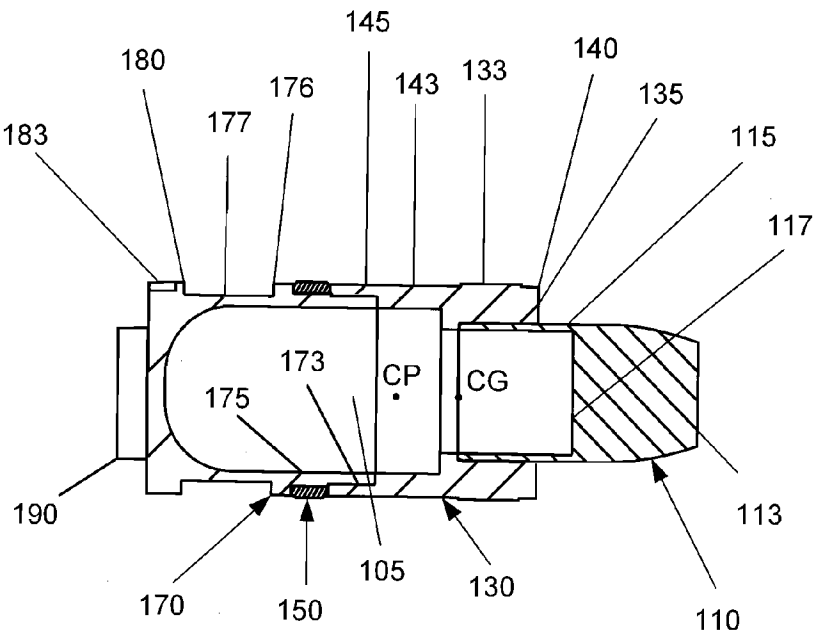
FIG. 2 is a side cross-sectional view of the finless projectile in FIG. 1, illustrating an inner hollow core.
Figure 3:
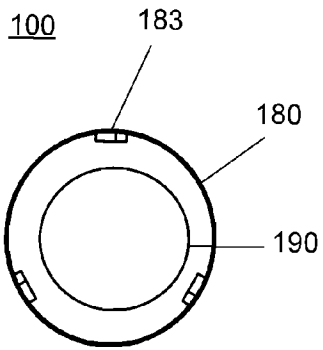
FIG. 3 is an end view of the finless projectile in FIG. 1, illustrating the circular cross-sectional shape of the cylindrical finless projectile, and the grooves on the aft circumferential flange of the aft projectile body.

The finless projectile 100 can best be illustrated by viewing FIGS. 1-3 together. FIG. 1 is an isometric view of a finless projectile 100 of the present invention, shown without a sabot. FIG. 2 is a cross-sectional side view of the finless projectile. The projectile 100 generally includes a slug 110 that is disposed at a front portion or proximal end of the projectile 100. The projectile 100 further includes a forward projectile body 130, an obturator 150, an aft projectile body 170, and a pad 190 that is located at a distal end of the finless projectile. The projectile 100 includes a hollow core 105 provided for by the slug 110, the forward projectile body 130 and the aft projectile body 170.

The finless projectile can be fired, for example, from a 40 mm De-Armer rifle, for explosive ordnance disposal such as disarming a fuse, and breaking open a lock. The center of gravity (C.G.) of the projectile 100 is positioned forward of a center of pressure (C.P.). This configuration provides static stability to the projectile 100.

In contrast to a projectile with a sabot, the finless projectile 100 of the present invention has fewer components, can be mass produced at a lower cost, and more readily achieves structural integrity in assembly and operation. Since the finless projectile 100 launches without generating high velocity fragments in the region surrounding the muzzle, the air flow around the finless projectile 100 presents less disturbance to slow down or change the trajectory of the projectile 100, resulting in higher muzzle velocity, improved targeting and excursion accuracy. Importantly, the finless projectile 100 reduces collateral damage as it does not generate fragments at launch.

With reference to FIG. 3, it illustrates the circular cross-sectional shape of the cylindrical finless projectile 100, and the grooves 183 on the aft circumferential flange 180 of the aft projectile body 170. Both the grooves 183 and the circumferential flange 180 will be described in fuller detail in connection with FIGS. 11-15. A circular pad 190 is located on the distal end of the finless projectile 100, or alternatively, on the aft surface of the aft projectile body 170 of the finless projectile 100. The pad 190 absorbs some of the forces on the finless projectile 100 resulting from the blast in bore.

Figure 5:
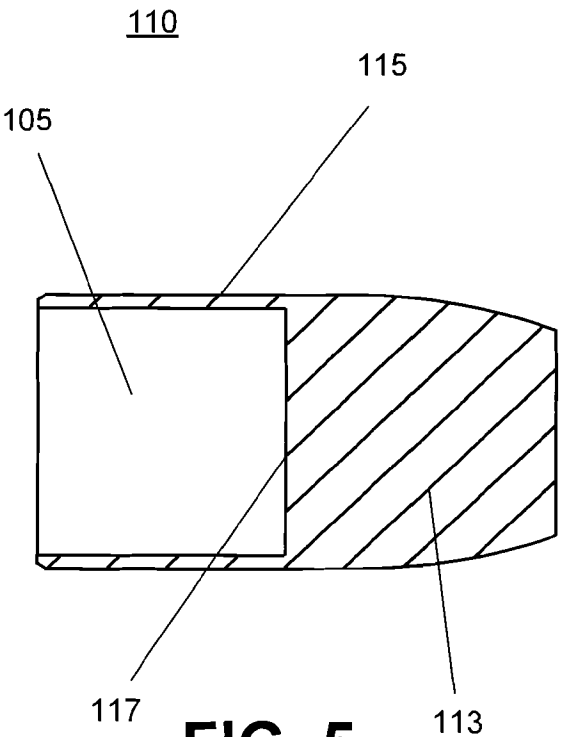
FIG. 5 is a side cross-sectional view of the slug of FIG. 4, illustrating part of the hollow core and a flat-nosed tip shape.
Figure 4:
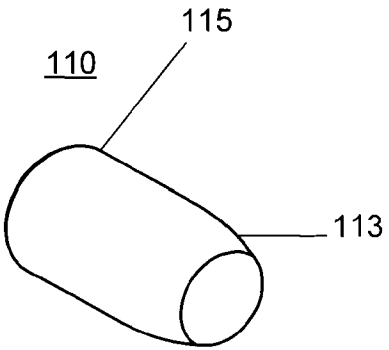
FIG. 4 is an isometric view of a slug that forms part of the projectile of FIGS. 1 and 2, illustrating a generally convergent bullet-tip shape.

The slug 110 will now be described in connection with FIGS. 4-6. FIG. 4 is an isometric view of the slug 110 from the front of the projectile 100, with a generally converging bullet shape at the tip of the slug 110. FIG. 5 is a side cross-sectional view of the slug 110 of FIG. 4, illustrating part of the hollow core 105 at the aft end of the slug 110. The slug 110 is assembled at the front end of the finless projectile 100 and is made of a suitable heavy metal, such as stainless steel or a similar material.

The finless projectile 100 and in particular the slug 110 have an aerodynamic shape that minimizes drag with a general bullet shape at the tip 113 of the slug 110, and a cylindrical body 115 that is integrally connected to the tip 113. The cylindrical body 115 has a uniform outer diameter to facilitate the assembly of the slug 113 with the forward projectile body 130.

Figure 6:
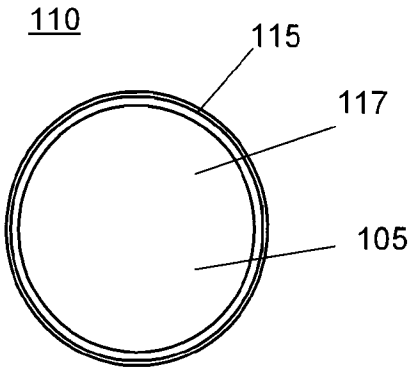
FIG. 6 is an end view of the slug of FIG. 4, illustrating the circular shape of the slug and the hollow core as shown in FIG. 5.

In the exemplary embodiment of FIGS. 4-6, the bullet shape tip 113 has a truncated bullet nose or alternatively a blunt nose. The bullet shaped tip of the slug 110 also has a flat rear bottom 117. The cylindrical body 115 is hollow and defines, at least in part, the hollow core 105 of the projectile 100. The blunt nose does not pierce the target upon impact but deforms the target, such as a fuse in a weapon.

The weight of the finless projectile 100 is concentrated in the front of the projectile where the flat bottom 117 of the tip of the slug is frontal to the front projectile body. One purpose of the finless projectile 100 is to disarm a target by kinetic energy, rather than by explosives. For example, in breaking open a door lock in an urban engagement, the finless projectile 100 travels a range of about 20 feet, and does not induce an explosion, minimizing harm to persons behind the door.

The finless projectile 100 has an outer diameter that is full bore, and launches without a sabot. Unlike the conventional sub-caliber projectile, the full bore finless projectile 100 has a cross-section that is similar or comparable to that of the launch bore or barrel of the weapon. The slug 110 has an outside diameter that is less than the overall diameter of the projectile 100 for reasons that will be explained later in conjunction with the forward projectile body 130. The tip 113 of the slug 110 has a blunt bullet shape and accounts for about half the weight of the slug 110.

In an exemplary embodiment, the tip 113 of the slug 110 has a length to lateral diameter at the flat bottom ratio, also called an aspect ratio, which ratio has a value close to 1. In a specific embodiment of the present invention, a significant percentage of the weight of the slug 110 is located at the tip 113 of the slug 110. The advantages of this tip shape and weight distribution include the transfer of most of the kinetic energy of the finless projectile 100 to the target upon impact, as the shape of the slug 110 undergoes little deformation upon target impact and absorbs a small amount of kinetic energy of the projectile 100. In other terms, at typical impact velocity, the finless projectile 100 achieves high terminal effectiveness on the target.

FIG. 6 is an end view of the slug 113, illustrating the circular shape of the slug 100 when viewed from the end portion. The circular wall of the cylindrical body 115 of the slug 110 defines at least in part, the hollow core 105. The flat bottom 117 of the tip 113 of the slug 110 is illustrated in the center of the end view of the slug 110.

Figure 7:
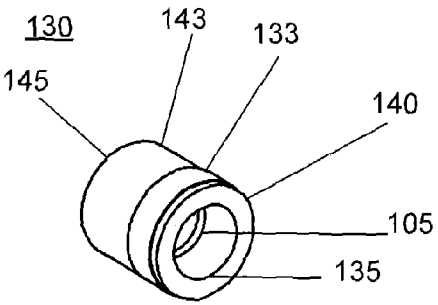
FIG. 7 is an isometric view of a forward projectile body that forms part of the projectile of FIGS. 1 and 2, shown provided with a hollow core adapted to form an integral assembly with an aft projectile body of FIGS. 11-15.
Figure 8:
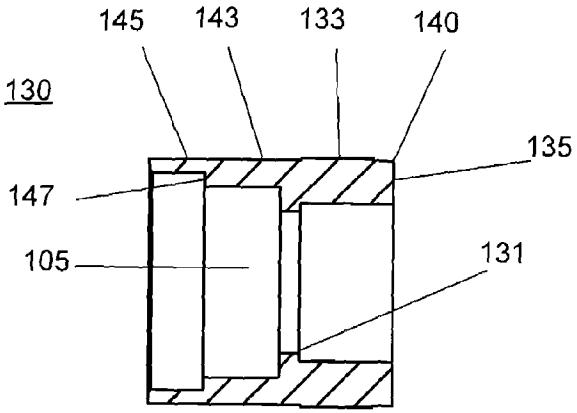
FIG. 8 is a side cross-sectional view of the forward projectile body of FIG. 7.
Figure 9:
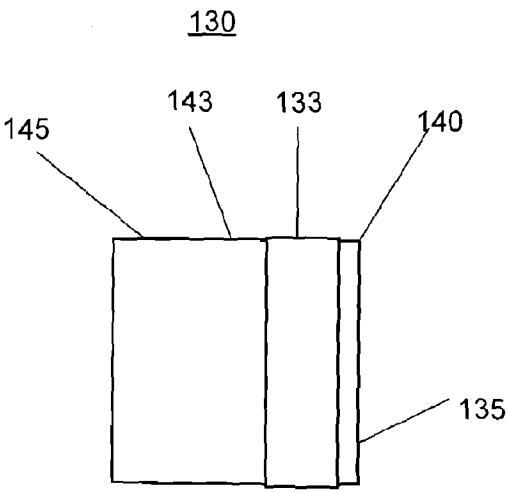
FIG. 9 is a side view of the forward projectile body of FIG. 7.

The forward projectile body 130 is illustrated in FIGS. 7-10. FIG. 7 represents an isometric view and FIG. 9 represents a side view of the cylindrical forward projectile body 130 that is provided with a Bourrelet 133 and a hollow core 105 with a front end and an aft end. The front end is adapted to mate with the slug 110 to form an integral assembly. The aft end is adapted to mate with the aft projectile body 170.

FIG. 8 represents a side cross-sectional view of the forward projectile body 130 as illustrated in FIG. 7. The forward projectile body 130 generally has a cylindrical shape, with the front end of the forward projectile body adapted to mate with the slug 110 by being positioned next to the cylindrical body 115 to form an integral assembly. The forward projectile body 130 is also adapted to mate, at its aft end, with the aft projectile body 170 to form an integral assembly.

The forward projectile body 130 is preferably made from aluminum or a material that is generally lighter than the material in the slug 110. The finless projectile 100 has a full bore caliber. Consequently, the generally cylindrical and circular cross-section shape of the forward projectile body 130 has an outside diameter that is slightly smaller than that of the launch barrel of the weapon. A circumferential band 133, having a slightly larger outside diameter than the rest of the forward projectile body 130, is located near the front of the forward projectile body 130. The circumferential band 133 is also referred to as a Bourrelet, provides a bearing surface at minimal friction between the projectile 100 and the launch barrel or bore of the weapon, in order to stabilize the launch.

Figure 10:
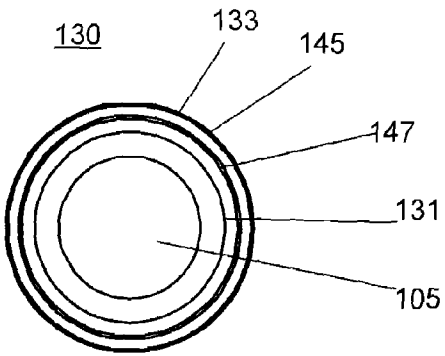
FIG. 10 is an end view of the forward projectile body of FIG. 7, illustrating the concentric configuration of an aft portion, two circumferential stops and a hollow core.

In the finless projectile 100, the cylindrical forward projectile body 130 includes an inner (or interior) hollow core 105, as illustrated in FIGS. 8 and 10. The cylindrical forward projectile body 130 includes a front portion 140 with the smallest inner diameter in the forward projectile body 130, a mid-portion 143 with the median inner diameter, and an aft portion 145 with the largest inner diameter.

The hollow core 105 is adapted to accept and to mate with the cylindrical body 115 of the slug 110 by the front portion 140. The front portion 140 is provided with a circumferential stop 131, which stop forms part of the forward projectile body 130, such that the partially bullet shaped tip 113 of the slug 110 is positioned in front of the forward projectile body 130. At this location, the slug 110 and the forward projectile body 130 are integrally assembled by interference fit, bonding, welding, brazing, or other suitable techniques.

In addition, the outer diameter of the slug 110 is smaller than that of the forward projectile body 130, such that when the slug 110 and the forward projectile body 130 are substantially concentric in an integral assembly, a circumferential shoulder 135 of uniform width is created perpendicular to the longitudinal axis of the projectile 100. In the exemplary embodiment illustrated in FIG. 2, this shoulder 135 is located behind the flat bottom 117 of the tip 113 of the slug 110, to place most of the weight of the slug 110 frontal to the forward projectile body.

The hollow core 105 in the forward projectile body 130 is also adapted to accept the aft projectile body 170 at the aft portion 145 provided with a circumferential stop 147 in the forward projectile body. The forward projectile body and the aft projectile body 170 are integrally assembled by interference fit, bonding, welding, brazing, or other suitable techniques.

FIG. 10 illustrates the end view of the forward projectile body 130, showing the concentric and circular features of the Bourrelet 133, the aft portion 145, the second circumferential stop 147, the first circumferential stop 131 and the hollow core 105.

Figure 11:
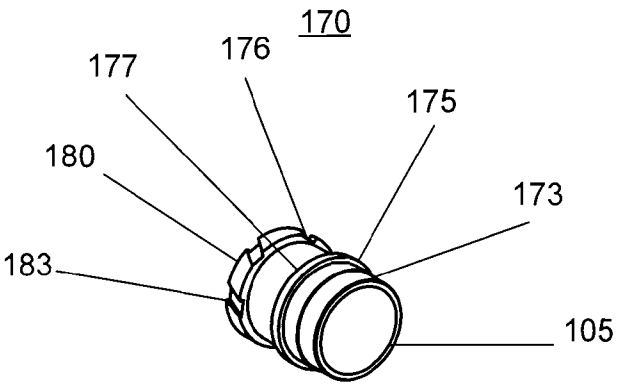
FIG. 11 is an isometric view of the aft projectile body provided with a plurality of grooves to induce spin to the projectile during flight.
Figure 12:
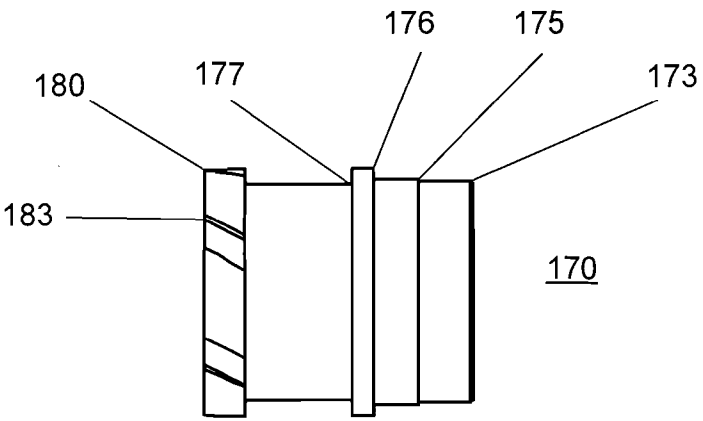
FIG. 12 is a side view of the aft projectile body of FIG. 11

The aft projectile body 170 is illustrated in FIGS. 11-15. FIG. 11 represents an isometric view of the aft projectile body 170 that is illustrated as being provided with a plurality of grooves, to induce spin to the projectile 100 during flight. FIG. 12 represents a side view of the aft projectile body illustrated in FIG. 11. FIGS. 13A and 13B represent different exemplary embodiments of the aft projectile body 170 illustrated in FIG. 11. The aft projectile body 170 defines at least in part, the hollow core 105 of the finless projectile 100. The aft projectile body 170 has a generally cylindrical shape and circular cross-section with an open end on the front and a closed end on the aft, and defines at least in part, the hollow core 105 of the finless projectile 100.

The aft projectile body 170 is preferably made from aluminum or a material that is generally lighter in weight than the material forming the slug 110. The aft projectile body 170 has an open-ended cylindrical shape and includes a uniform inner diameter that defines at least in part, the hollow core 105. The aft projectile body 170 includes a front portion 173 that mates with the aft portion 145 of the forward projectile body 130 to form an integral assembly.

A circumferential band 175 is located behind the front portion 173, and has a slightly larger outer diameter than that of the front portion 173. The circumferential band 175 supports obturator 150 as it will be explained later in greater detail. A circumferential ring 176 is located behind the obturator band 175 and has an outer diameter that is larger than that of the obturator band or circumferential band 175, but smaller than the outer diameter of the obturator 150. An aft portion is disposed behind the circumferential ring 176, and includes an aft section 177, an aft circumferential flange 180, and a bottom plate 179 that forms an enclosure to the hollow core 105.

Figure 13B:
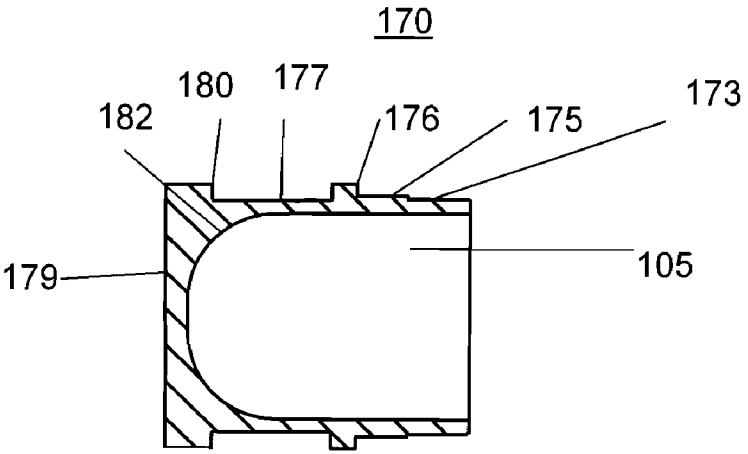
FIG. 13 (comprising FIGS. 13A and 13B) are side cross-sectional views of two embodiments of the aft projectile body of FIGS. 11 and 12.
Figure 13A:
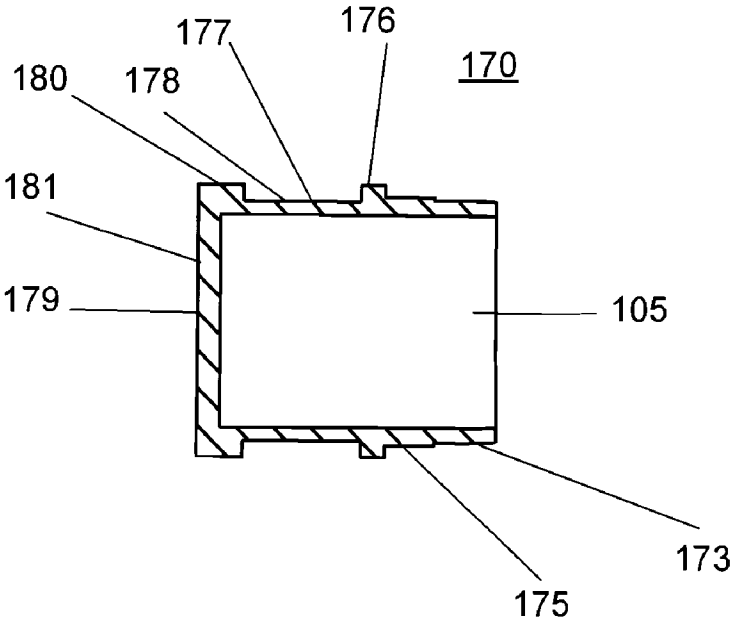

FIGS. 13A and 13B illustrate different embodiments of the aft projectile body 170. The bottom plate 179 of the aft projectile body 170 encloses the hollow core 105, and forms a right angle with the aft section 177, as illustrated in FIG. 13A. Alternatively, the bottom plate 179 forms a radius 182 for higher strength with the aft section 177, as illustrated in FIG. 13B.

The outer diameters of the aft section 177 and the aft circumferential flange 180 are smaller than that the outer diameter of the obturator 150. In an exemplary embodiment, the aft section 177 of the aft projectile body 170 has an outer diameter that is smaller than those of the circumferential ring 176 and the aft circumferential flange 180, such that during flight, air flows into a volume 178 behind the circumferential ring 176, to reach the aft circumferential flange 180.

The aft circumferential flange 180 is further provided with a plurality of grooves 183 that are disposed at an angle relative to the longitudinal axis of the finless projectile 100, as illustrated in FIGS. 11-12 and 14-15. As a result, the grooves 183 are also referred to as angular grooves. After the air flows past the aft section 177, it enters the angular grooves 183 and induces a spin to the finless projectile 100 during flight, further enhancing stability and target aiming accuracy.

Figure 14:
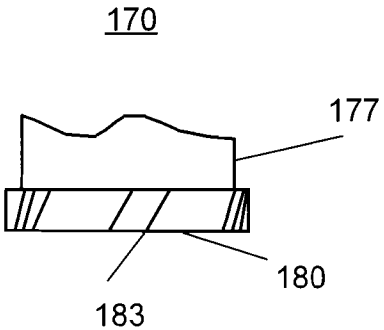
FIG. 14 is a partial side view of the aft projectile body of FIG. 11, illustrating the grooves and circumferential flange of the aft projectile body.

FIG. 14 is a partial side view of the aft section 177, illustrating the plurality of angular grooves 183 of the circumferential flange 180. The diameter of the circumferential flange 180 is larger than the outer diameter of the aft section 177.

Figure 15:
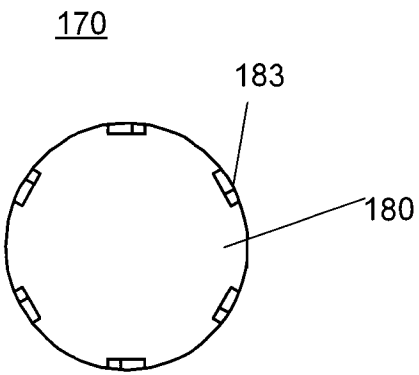
FIG. 15 is an end view of the aft projectile body in FIG. 11, illustrating the grooves and circular shaped circumferential flange of the aft projectile body.

FIG. 15 is an end view of the aft projectile body 170, illustrating the circular cross-section of the circumferential flange 180 and the plurality of angular grooves 183 of the circumferential flange 180.

The angular grooves 183 cause the finless projectile 100 to spin in flight. A preferred number of angular grooves 183 ranges between 3 and 8. The depth of the angular grooves can vary but is preferable when the bottom of the groove is level with the outer surface of the aft section 177 of the aft projectile body 170, in order to minimize any air flow disruption at the angular grooves 183 and to achieve a smooth air flow pattern.

Figure 18:
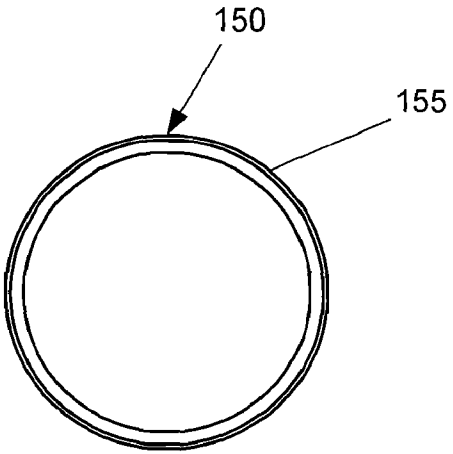
FIG. 18 is an end view of the circular shaped obturator of FIG. 16.
Figure 16:
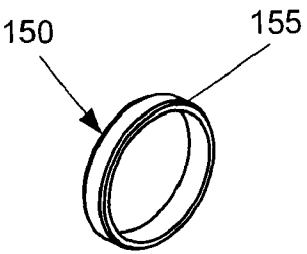
FIG. 16 is an isometric view of an obturator that fits around the outside perimeter of the aft projectile body of FIGS. 11-15.
Figure 17:
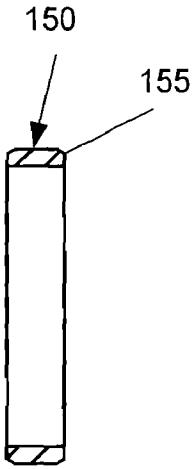
FIG. 17 is a cross-sectional side view of the obturator of FIG. 16, illustrating chamfers on both sides of the obturator.
Figure 19:
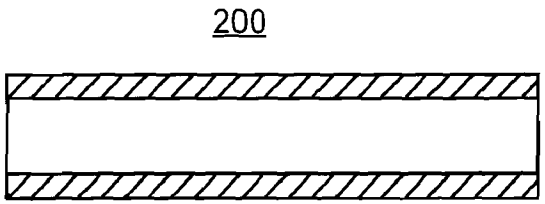
FIG. 19 shows the cross section of a weapon barrel 200.

The obturator 150 is illustrated in FIGS. 16-18. FIG. 16 represents an isometric view of an obturator 150 that is disposed between the forward projectile body 130 and the aft projectile body 170, as illustrated in FIG. 2. The obturator 150 fits tightly on the outside perimeter of the circumferential band 175 of the aft projectile body 170.

The finless projectile 100 has an outer diameter that is full bore, with the obturator 150 in a snug sliding fit with the barrel of the weapon. FIG. 17 represents a cross-sectional side view of the obturator 150, as illustrated in FIG. 16, further illustrating chamfers 155 on both sides of the obturator 150.

The obturator 150 is generally made from a plastic material, for example nylon. The obturator 150 is generally annularly shaped. The outer diameter of the obturator 150 is the largest outer diameter of the finless projectile 100. The outer diameter of the obturator 150 matches the bore size of the launch barrel, such that the obturator 150 seals the propellant gases in the weapon behind the obturator 150, as the projectile 100 is launched from the weapon barrel 200.

The obturator 150 is provided with chamfers 155 on its front and aft outer corners, to reduce friction and stress with the launch barrel 200. The inner diameter of the obturator 150 tightly wraps around the outer surface of the circumferential band 175. In addition, the obturator 150 is located between the aft portion 145 of the forward projectile body 130 and the circumferential ring 176 of the aft projectile body 170, such that the obturator 150 remains in place during the barrel launch and in flight. The obturator 150 is integrally assembled to the forward projectile body 130 and aft projectile body 170 by placement, pressure fit, bonding, or another suitable technique.

FIG. 18 is an end view of the obturator 150, further illustrating the circular cross-section of the obturator 150 and the chamfers 155. The finless projectile 100 is launched from a circular bore of a barrel 200, with the circular obturator 150 in snug, sliding contact with the bore of the barrel 200 during the projectile launch.

The finless projectile 100 is supported inside the bore by sliding contact during the launch from the bearing surface of the Bourrelet 133 in the forward projectile body 130, and from the obturator 150 that is located on the aft projectile body 170, which obturator presses against the launch barrel or the bore. The snug support on the finless projectile 100 improves the target aiming and excursion accuracy.

With reference to FIG. 2, the pad 190 is generally made from a plastic material such as rubber, or any composite material that contains rubber. The pad 190 generally has a circular shape, and attaches by adhesive, for example, to the aft outer surface of the aft projectile body.

In an exemplary process to assemble the finless projectile 100, the aft projectile body 170 is placed with the groove 183 side at the bottom, the obturator 150 is integrally assembled onto the aft projectile body 170 against the circumferential ring 176, the forward projectile body 130 is integrally assembled onto the aft projectile body 170 against the stop 147. The slug 110 is assembled to the forward projectile body 130 against the stop 131 as described earlier. The pad 190 is then assembled onto the aft surface 181 of the aft projectile body 170.

In general, the impact momentum and kinetic energy of the projectile 100 are determined by its impact velocity and weight. As described earlier, the finless projectile 100 that has an aerodynamic shape in a slug 110 that minimizes drag and achieves high velocity, and a the slug 110 that concentrates the weight of the finless projectile 100 onto the front of the projectile 100.

The full bore finless projectile 100 imparts a high kinetic energy for explosive ordinance disposal. In other terms, the present finless projectile design enhances the terminal effectiveness of the finless projectile 100. The simple structure of the finless projectile 100 results in lower cost relative to the conventional projectile with a sabot.

It is to be understood that the specific embodiments of the invention that have been described are merely illustrative of certain applications of the principle of the present invention. Numerous modifications may be made to the present invention described herein, without departing from the spirit and scope of the present invention.

What is claimed is:

1. A finless projectile for firing from a barrel of a weapon, to impart kinetic energy to a target, comprising:

an inner hollow core;

a slug including a cylindrical body and a tip;

a cylindrical forward projectile body that forms the inner hollow core and that includes a front open end and an aft open end, wherein when assembled, the front open end integrally engages the cylindrical body of the slug;

a generally cylindrical aft projectile body that forms the hollow core and that includes a front open end and a closed aft end, wherein when assembled, the front open end integrally engages the forward projectile body;

an obturator disposed between the forward projectile body and the aft projectile body, wherein the obturator seals propellant cases inside the weapon;

wherein the finless projectile is full bore so that a cross-section of the forward projectile body approaches a cross-section of the barrel, thus eliminating the need for a sabot;

wherein the finless projectile includes a center of gravity and a distinct center of pressure, wherein the center of gravity is disposed forward of the center of pressure, in order to provide static stability to the finless projectile; and wherein the tip of the slug has a truncated bullet shape to transfer the kinetic energy to the target, wherein the aft projectile body comprises an aft circumferential flange with grooves that are disposed at an angle relative to a longitudinal axis of the finless projectile, in order to induce spin during flight, wherein the finless projectile further comprises a pad that attaches to the aft surface of the aft projectile body, in order to absorb forces on the projectile from mechanical contact.

2. The finless projectile of claim 1, wherein when the projectile is assembled, the slug has an outer diameter that is smaller than an outer diameter of the forward projectile body, to provide a circumferential shoulder between the slug and forward projectile body.

3. The finless projectile of claim 2, wherein the tip of the slug is frontal to the forward projectile body, in order to concentrate the weight of the finless projectile to the front.

4. The finless projectile of claim 1, wherein the aft section of the aft projectile body has an outer diameter that is smaller than an outer diameter of the aft circumferential.

5. The finless projectile of claim 1, wherein the optimal number of grooves ranges between 3 and 8 grooves.

6. The finless projectile of claim 1, wherein the slug is made of stainless steel.

7. The finless projectile of claim 1, wherein the forward projectile body is made of aluminum.

8. The finless projectile of claim 1, wherein the aft projectile body is made of aluminum.

9. The finless projectile of claim 1, wherein the obturator is made from a class of material comprising plastic and nylon.

10. The finless projectile of claim 1, wherein the pad is made of rubber.

* * * * *